US008702439B1

(12) United States Patent
Paulsel et al.

(10) Patent No.: US 8,702,439 B1
(45) Date of Patent: Apr. 22, 2014

(54) WET MATEABLE UNDERWATER CONNECTOR

(75) Inventors: Roger Q Paulsel, Weatherford, TX (US); Donald W. Murray, Arlington, TX (US); Michael A. Parvaresh, Austin, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 360 days.

(21) Appl. No.: 13/182,812

(22) Filed: Jul. 14, 2011

Related U.S. Application Data

(60) Provisional application No. 61/441,648, filed on Feb. 10, 2011.

(51) Int. Cl.
*H01R 13/52* (2006.01)

(52) U.S. Cl.
USPC ..... 439/271; 439/936; 439/276

(58) Field of Classification Search
USPC ..... 439/936, 271–276, 201
See application file for complete search history.

(56) References Cited

U.S. PATENT DOCUMENTS

| | | | | |
|---|---|---|---|---|
| 3,643,207 | A | 2/1972 | Cairns | |
| 3,972,581 | A | 8/1976 | Oldham | |
| 4,085,993 | A | 4/1978 | Cairns | |
| 4,425,017 | A | 1/1984 | Chan | |
| 7,690,936 | B1 * | 4/2010 | Snekkevik et al. | 439/281 |
| 2009/0163064 | A1 * | 6/2009 | Janulis et al. | 439/271 |

* cited by examiner

*Primary Examiner* — Briggitte R Hammond
(74) *Attorney, Agent, or Firm* — Morani Patent Law, PC

(57) ABSTRACT

Electrical connectors suitable for wet environments and even underwater mating are provided. A replaceable gel filled cartridge affixes over sockets of a female plug. Water channels and radial holes in the receptacle combine to form a pathway for water ejection during connection formation. A coupling nut secures the female plug to the male connector. A spring housed within the coupling nut allows the coupling nut to further rotate, after pins are seated in respective sockets, to seal water holes. The cartridge is filled with hydrophobic gel and has a diaphragm sandwiched between a front and a rear housing. Contact pins pass through the diaphragm and pass through the gel filled rear housing before mating with respective sockets. Trapping of water is minimized with the escape of water via channels in the receptacle. Contaminated or lost gel is readily replaced via the cartridge affording multiple wet-mateable connections for a given connector.

12 Claims, 12 Drawing Sheets

WET MATEABLE UNDERWATER CONNECTOR

CROSS REFERENCE TO RELATED APPLICATIONS

This application claims priority to U.S. Provisional Application No. 61/441,648, filed 10 Feb. 2011, the entire contents of which are incorporated herein by reference.

STATEMENT REGARDING FEDERALLY SPONSORED RESEARCH

This invention was made with government support under Contract No. N65538-09-M-0115 between the United States Navy and Williams-Pyro, Inc. The government may have certain rights in the invention.

BACKGROUND OF THE INVENTION

The present invention relates generally to electrical connectors and more particularly to connectors which can be mated underwater.

To avoid water contamination, conventional receptacle and female plug electrical connectors may be sealed by o-rings or gaskets. These designs may work well in generally dry environments. However, electrical connectors in some applications may be exposed to non-dry air environments, such as humid air, rain, or sprayed seawater. Further still, a connector may be submerged in, for example, ships, submarines or underwater equipments. Even such underwater connector halves may be conventionally sealed by o-rings or gaskets. It is desirable to exclude water from the electrically live portions of the connectors as, among other things, water may create electricity leakage paths. Water can damage the electrically conducting connectors by corrosion or by deposition of insulating salt or impurity onto the connectors. In certain applications and environments, it is desirable to not only exclude water after being mated, but also to exclude water during mating, even when mating under water.

Conventional connectors addressing underwater mating or mating in a wet environment may be complex. They may be filled with oil. Said conventional connectors may have many small parts, such as valves and springs. Due, at least in part, to their complexity, conventional connectors may be difficult to build and repair. Such connectors may be expensive to produce and replace. Dielectric gel containing connectors can also be designed to allow underwater mating of connectors with water exclusion, for example U.S. Pat. No. 4,425,017 to Chan. However, repeated connection and disconnection of these gel-containing connectors may lead to contamination, leakage of the gel, or other compromise.

Conventional hermetic sealing connectors may be difficult to connect and disconnect due, at least in part, to pressure created during connection and a partial vacuum created during disconnection.

It would be desirable to have connectors that can hermetically seal in the face of multiple connect and disconnect operations. A connector which was relatively user friendly during contact engagement and disengagement, may also be desirable.

SUMMARY OF THE INVENTION

The present invention addresses some of issues presented above by providing an electrical connector with hermetic sealing when being mated underwater. Embodiments of the present invention enable formation of a hermetic seal across multiple disconnections and reconnections. Aspects of the invention are provided for summary purposes and are not intended to be all inclusive or exclusive. Embodiments of the present invention may have any of the aspects below.

One aspect of the present invention is continued hermetic sealing across the connector after repeated connections and disconnections.

Another aspect of the present invention is a renewable seal via a replaceable cartridge in a connector with sockets.

Another aspect of the present invention is to remove water from contact pins, at least in part, via an elastomeric diaphragm water when the connectors are being mated underwater.

Another aspect of the present invention is to avoid electricity leakage, in part, by using insulating gel contained in the replaceable cartridge.

Another aspect of the present invention is using cone-shaped perforations in an elastomeric diaphragm to attenuate water ingress and gel egress from a replaceable cartridge.

Another aspect of the present invention is tapered ribs in pin guide-through holes in the rear housing of the gel cartridge.

Another aspect of the present invention is to enable water expulsion during connector connection via water pathways.

Another aspect of the present invention is to facilitate water reintroduction during disconnection.

Another aspect of the present invention is ease of connector assembly and disassembly. And another aspect is ease of cartridge replacement using a gasket or an o-ring and a retainer nut or using either of the gasket or the o-ring with a retaining ring.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Parallel numbers across figures are used for convenience, however, numbers and corresponding connector elements need not be consistent across figures.

Figure 1A:
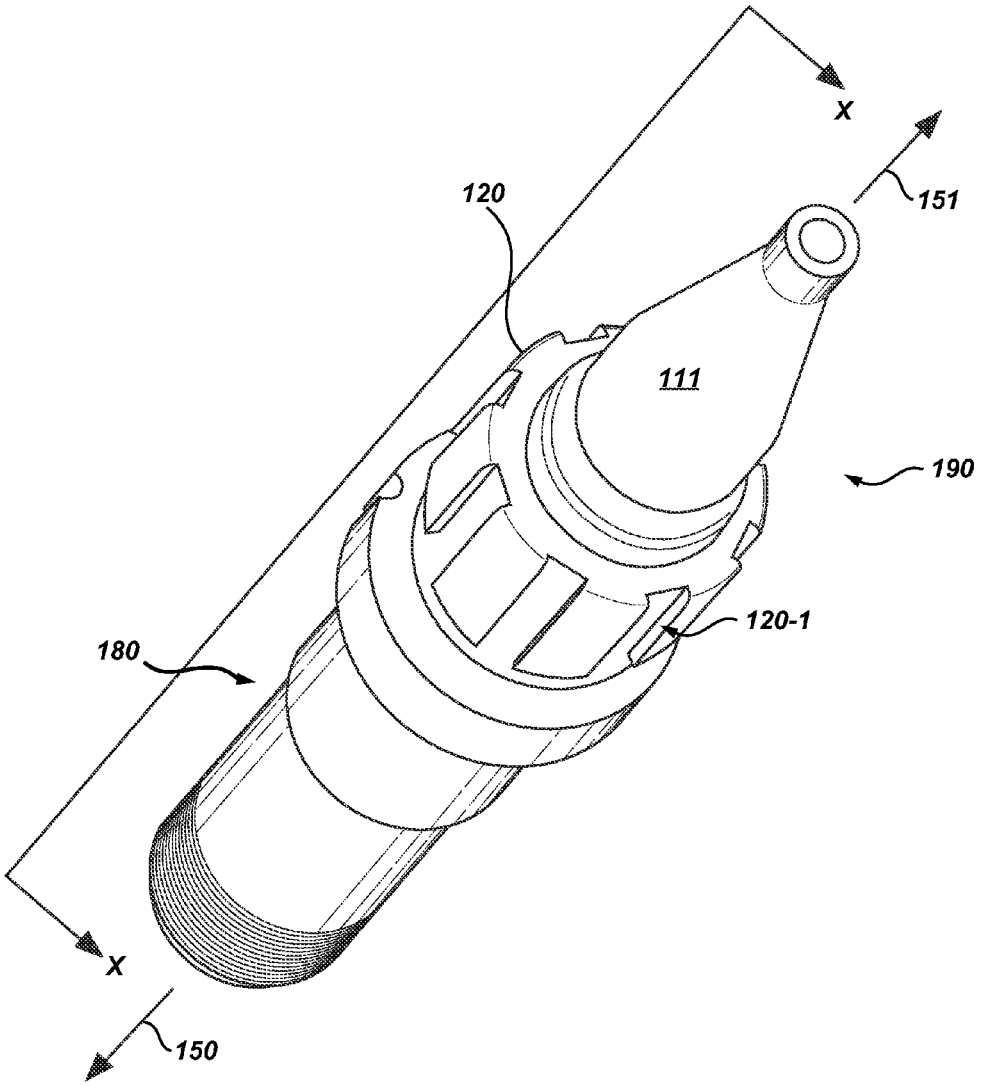
FIG. 1A shows an aft perspective view of a mated connector, male receptacle and female plug, in accordance with an exemplary embodiment of the present invention.
Figure 1B:
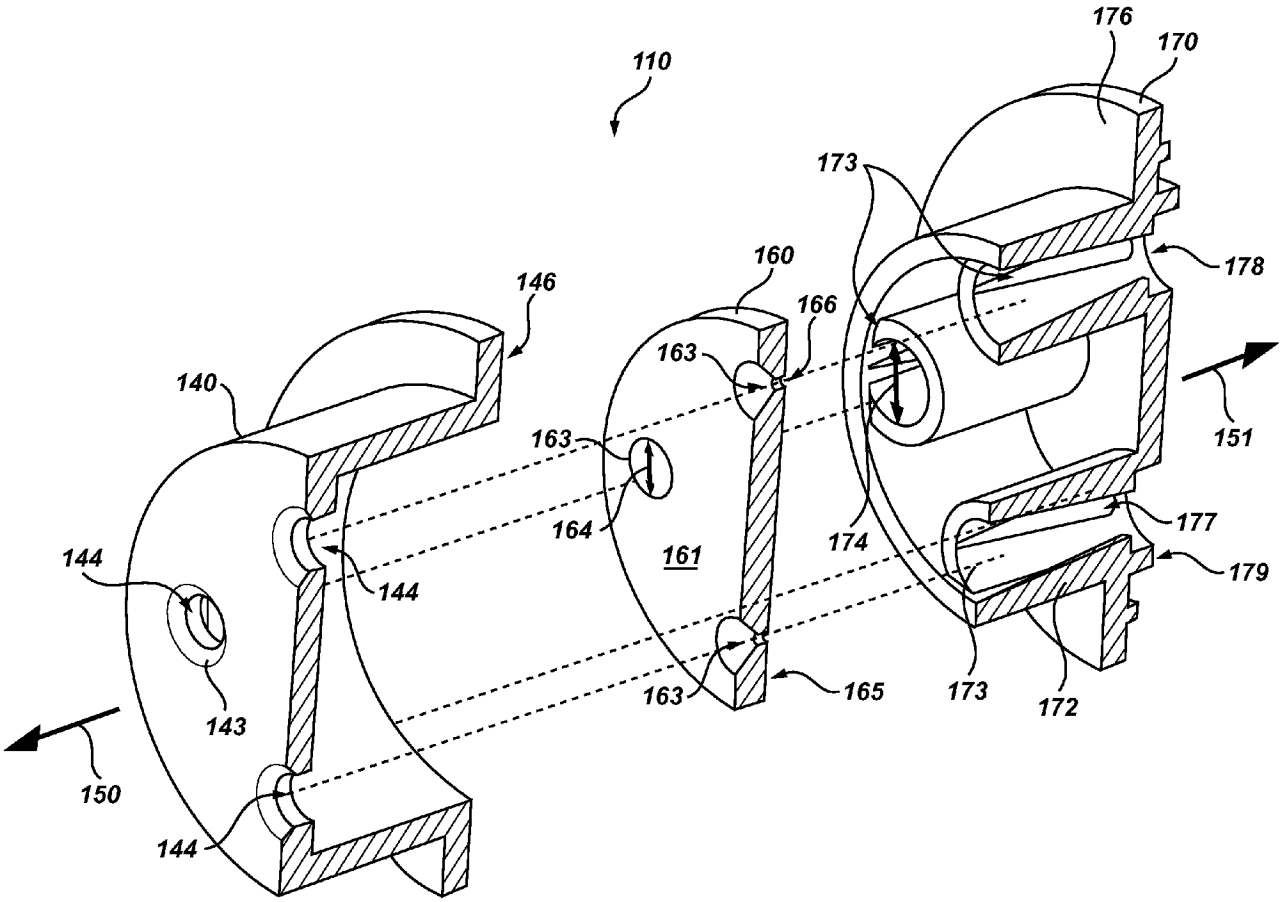
FIG. 1B shows an exploded cross section view of an exemplary gel cartridge assembly of a connector, taken along line XX of FIG. 1A, in accordance with an embodiment of the present invention.

FIG. 1A shows an aft perspective view of a mated connector in accordance with an exemplary embodiment of the present invention. An over mold 111 of a female plug is shown in the foreground. Moving forward 150 from the aft end 151, a coupling nut 120 secures the female plug 190 to a male receptacle 180. Exemplary coupling nuts 120 include ridges 120-1 for gripping of the same. In accordance with an alternate embodiment, the coupling nut may comprise grooves at the position ridges 1204 for turning of the coupling nut with a spanner wrench. In between, the female plug 190 and the male receptacle 180 and housed within the connector is a replaceable gel cartridge, not shown in this perspective view. FIG. 1B shows an exploded cross section view of an exemplary gel cartridge assembly of a connector, taken along line XX of FIG. 1A, in accordance with an exemplary embodiment of the present invention. Briefly, FIG. 1B shows a front housing 140, an elastic diaphragm 160 and a rear housing 170 with its pin through-guides 173. The front housing 140 has holes 144 for insertion of male connector pins. On a frontwards 150 face 141 of front housing 140, holes 144 have a chamfered configuration 143. The replaceable cartridge is further described below with reference, again, to FIG. 1B.

Figure 1C:
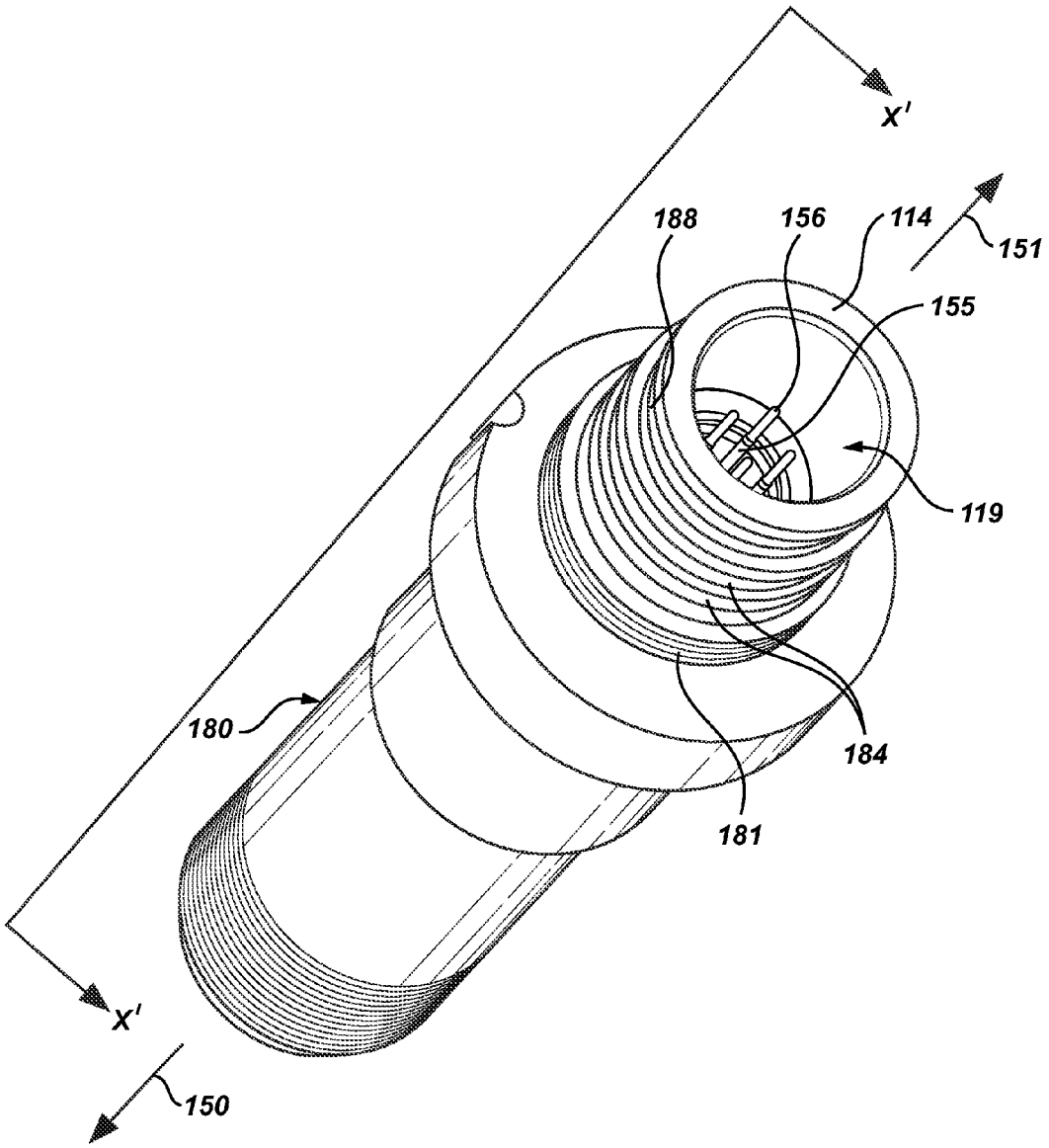
FIG. 1C shows a perspective view of a receptacle with pins from a mating end, in accordance with an exemplary embodiment of the present invention.

Turning to FIG. 1C, FIG. 1C shows a perspective view of a receptacle from a mating end, in accordance with an exemplary embodiment of the present invention. Keeping with the same direction indicators of FIG. 1A, the mating end of the receptacle will refer to an aft end 151. The receptacle opening 119 is shown in the foreground with contact pins 156 visible. Moving in forward direction 150, insulation 155 on the contact pins 156 will be further described with reference to FIG. 5B below. Referring again to FIG. 1C, an o-ring seal 188 fits into a groove just forward 150 of mating end surface 114. Further forward of o-ring 188 is a pair of vent o-rings 184, which also fit into respective grooves in the receptacle connector 180. Moving still forward, external threads 181 provide the mating threads for the coupling nut 120, shown in FIG. 1A.

Figure 2A:
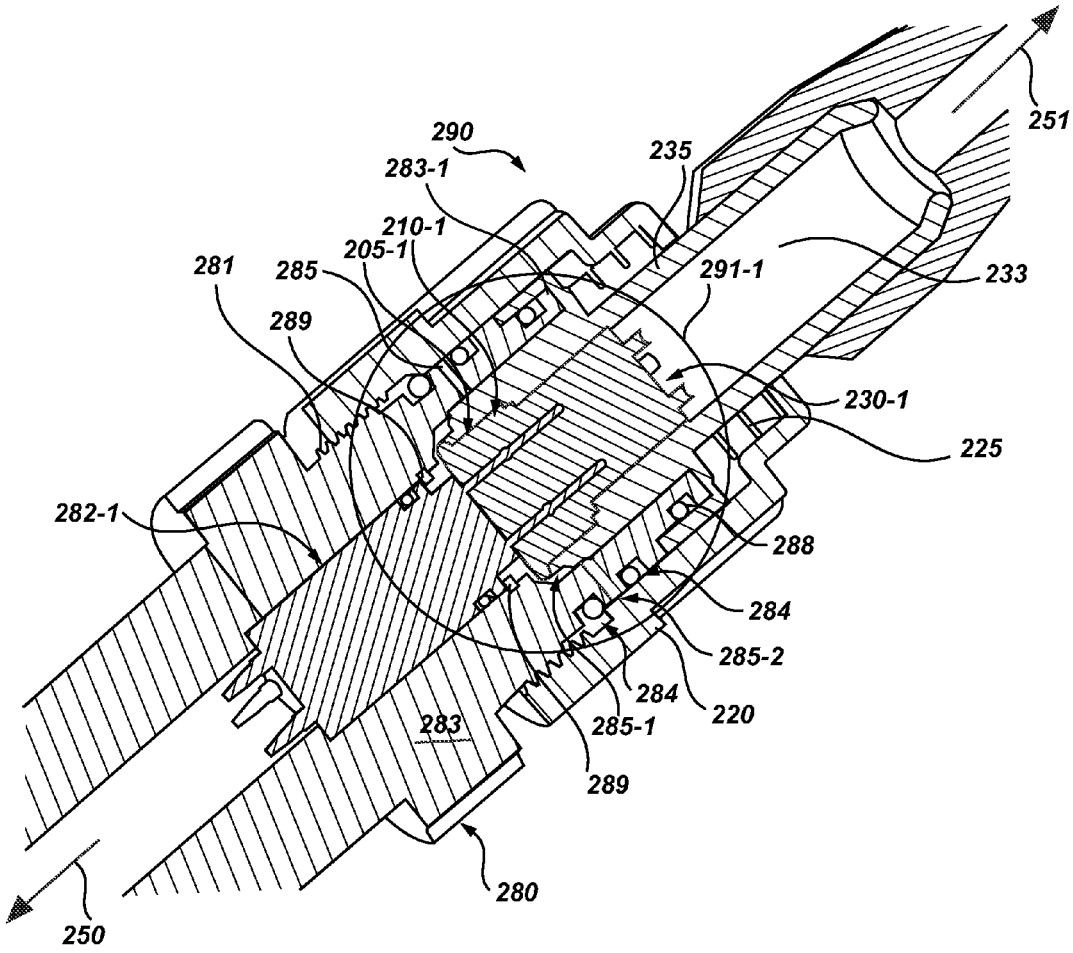
FIG. 2A shows a cross section view of a mated exemplary connector, where the cross section is taken along line XX of FIG. 1A, in accordance with an embodiment of the present invention.

FIG. 2A shows a cross section view of the mated connector of FIG. 1A along line XX, in accordance with an exemplary embodiment of the present invention. Male receptacle 280 and female plug 290 are secured together by coupling nut 220. Forward 250 and aft directions 251 are consistent across drawings. Housed within the female plug 290 are a socket insert 230-1 and a replaceable gel cartridge 210-1, where the replaceable cartridge is secured with a retainer nut 205-1, and where the insert 230-1, the cartridge 210-1 and the retainer nut 205-1 are shown as a single unit in this view. A receptacle insert with contact pins is also shown as a single unit 282-1, with the contact pins passing through the gel cartridge 210-1 and into respective contact sockets, not shown. Insert 230 seats into female shell 235. Cavity 233 in female shell 235 is filled with epoxy in accordance with an exemplary embodiment. In accordance with the exemplary embodiment of FIG. 2A, the receptacle insert 282-1 is secured with a retaining ring 289. In alternate embodiments, a receptacle insert is secured by an alternate fastener. Water channel 285-1 runs from an inner surface on the outer housing of the receptacle connector 280 and connects with water vent holes 285-2, 285. The water channel 285-1 and water vent holes 285-2, 285 combine to allow water to escape during mating of the female plug 290 and male receptacle 280 underwater. A portion of water channel 285-1 circumscribes an aft 251 portion of male insert 282-1. In accordance with an exemplary embodiment, shown in FIG. 2A, a second water vent hole 285 receives water from the water channel and is spaced 180 degrees from water vent hole 285-2. In exemplary embodiments of the present invention, water channel 285-1 may feed into one or more water vent holes, spaced about the circumference of the receptacle. In accordance with still another embodiment, the water vent holes are spaced at equal radial intervals about the circumference of the receptacle.

Vent o-ring seals 284 seal with an interior face of coupling nut 220 preventing ingress of water between the two o-rings 284 and through the channel 285-2. These same o-rings flank and seal water vent hole 285. The coupling nut 220 couples the female plug to the receptacle and bridges the gap between the two o-rings as a second inner diameter of the coupling nut circumscribes the o-ring pair 284. Coupling nut 220 is described in further detail with reference to FIG. 3 below. Returning to FIG. 2A, internal threads 221 on the coupling nut 220 mate with external threads 281 on the receptacle 280. A wave spring 225, shown in FIGS. 2A and 2B, circumscribes 235 and seats inside an aft 251 portion of the coupling nut 220.

Figure 2B:
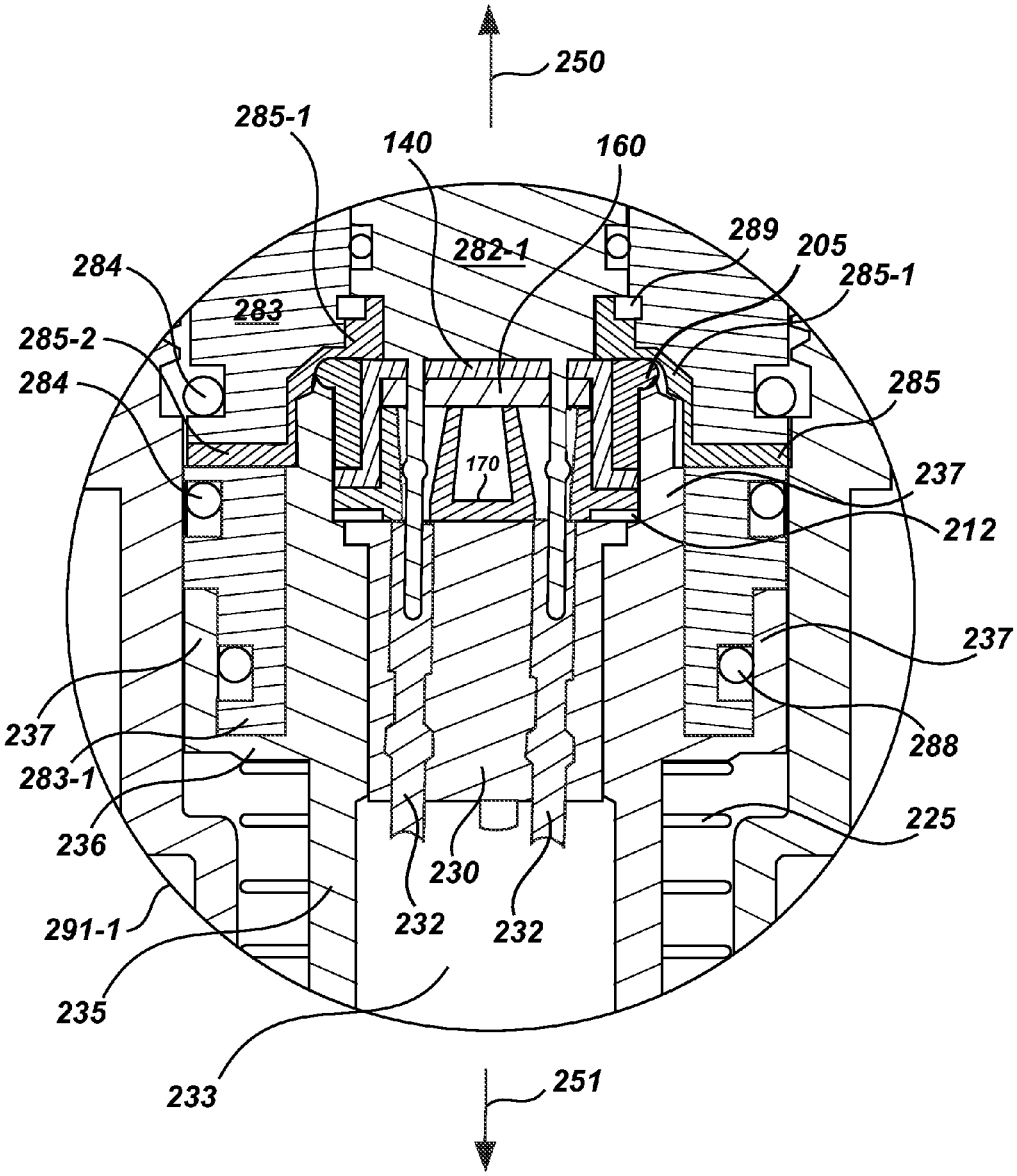
FIG. 2B shows a portion of FIG. 2A in greater detail.

FIG. 2B shows a portion 291-1 of FIG. 2A in greater detail. Portion 291-1 is rotated in FIG. 2B relative to FIG. 2A and resulting forward 250 and 251 directions are shown for ready reference. Exemplary water paths 285-1 to 285-2 and 285-1 to 285 are shown more clearly. In FIG. 2B water channel 285-1 and connecting water vent holes 285-2, 285 are shown with cross section lines, as if the hollow spacing is filled in, for illustrative purposes. In practice, these shaded regions are hollow, as shown in FIG. 2A, for example. Wave spring 225, shown in FIGS. 2A and 2B, allows the coupling nut 220 to continue engaging threads on the receptacle after the plug sockets and receptacle pins are fully seated. In turn, as the coupling nut 220 is drawn further over the receptacle 280, vent holes 285-2, 285 are sealed. Referring again to FIG. 2B, contact pins of receptacle insert 282-1 pass through the gel cartridge 210 and into respective contact sockets 232 of socket insert 230. Insert 230 seats into female shell 235. In accordance with an exemplary embodiment cavity 233 of female shell 235 is filled with epoxy affixing insert 230 in place.

In between the receptacle insert 282-1 and socket insert 230 fits gel cartridge 210. Washer 212 provides a seal across the socket insert 230 and the gel cartridge 210. Retainer nut 205 secures the gel cartridge 210 to female shell 235. The gel cartridge's front housing 140, a diaphragm 160, and a rear housing 170 are shown. Exemplary details of gel cartridge 210 are provided with reference, again, to FIG. 1B. Perforated elastomeric diaphragm 160 trapped between the two parts, 140, 170 has holes 163 to allow the contact pins to penetrate. The diaphragm has a front face 161 and a rear face 165. The diaphragm holes 163 have a rear diameter 166 smaller than a diameter of the connector's contact pins, not shown. These holes 163 may wipe water from the pins as they are inserted, and may wipe gel from the pins as they are withdrawn. The diaphragm holes have a front diameter 164, which is greater than respective rear diameter 166. The rear diameter 166, which is smaller than the respective contact pin outer diameter but accommodates insertion of a contact pin during connection. For each pin, the rear housing 170 has a tube-like structure, a pin through-guide 173. On the inner diameter of the openings, tapered ribs 177 center the pin while allowing a desired volume of gel to surround the pin. The cross sectional view cuts through the center of opposing ribs 172 and shows their taper. In an exemplary embodiment, there are four ribs per guide-through, which are evenly separated by ninety degrees. This rib tapering is shown in the walls 172 of the pin through-guides 173. These ribs assist in aligning the contact pins with the sockets of the female plug.

There is a circular recess 178 at the rear face 179 of the rear housing 170. Each recess 178 aligns with a front of a respective socket, not shown. The top of the socket fits into the recess 178. The effective rear diameter of the guide-through is less than the front diameter 174 in view of the tapered ribs. A rear housing 170 is at the rear 151 end of the gel cartridge assembly. The front housing 140 is on the front 150 side of the assembly and the two hold the elastomeric diaphragm 160 sandwiched between the front 140 and the rear housings 170. The through-guides openings serve as a lead-in to align pins with the sockets in the female plug. Alignment of the front and rear housings and diaphragm is performed during assembly of the cartridge. A decal, not shown, on the rear 151 face of the rear housing 170 can be used to hold in the gel until the cartridge is installed in the female connector. Raised sockets, not shown, on the female plug fit into openings 178, to align a replaceable cartridge with the female plug.

Front housing 140 has a cylinder side wall 145 in between its front face 141 and rear lip 146. Rear housing 170, likewise has a cylinder side wall 175 running from its front edge 171 to its rear lip 176. When assembled the outer surface of wall 175 nests inside the inner surface of wall 145, as shown for example in FIG. 2B. Exemplary parts of the gel cartridge 210, front housing 140, diaphragm 160, and back housing 170, seated and secured in the female shell 235 in FIG. 2B.

Figure 2C:
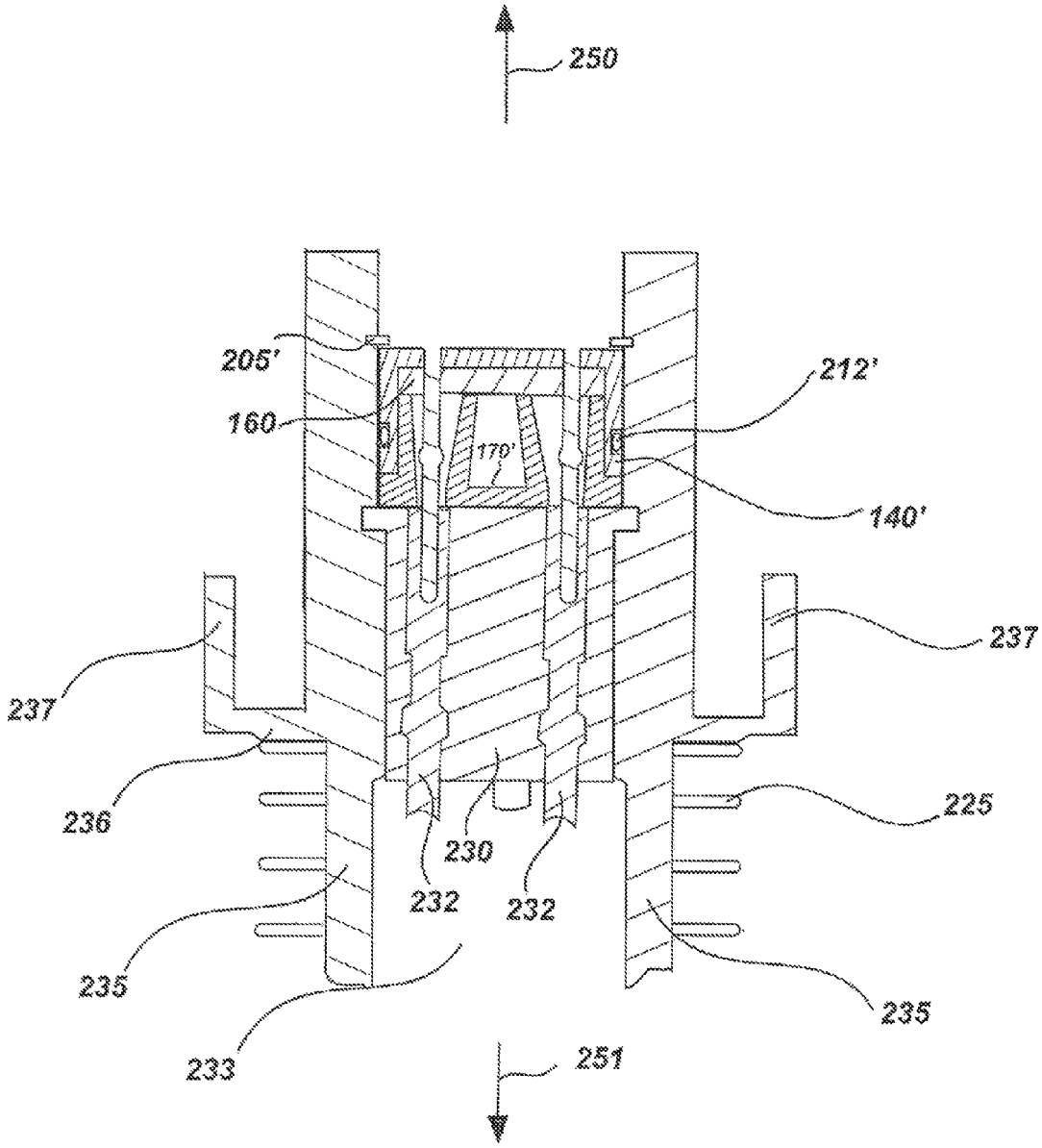
FIG. 2C shows a cross section view, taken along line XX of FIG. 1A, of another exemplary embodiment of a female shell with gel cartridge, in accordance with the present invention.

FIG. 2C shows a cross section view, taken along line XX of FIG. 1A, of another exemplary embodiment of a female shell with gel cartridge, in accordance with the present invention are shown. The front housing 140' and rear housing 170' of the gel cartridge are fixed into the female shell 235 by a retaining ring 205'. Socket contacts 232 may extend into openings of the rear housing 170', extension into housing not shown. The front housing 140' and the rear housing 170' hold the elastomeric diaphragm 160 sandwiched between the two. A radial seal is provided between the front housing 140' of the gel cartridge and an inner wall of the female insert 230 via o-ring 212'. Insert 230 seats into female shell 235. In an alternate embodiment, a face seal may be desired. The thickness of the outer front housing 140' wall may be thicker on a radial seal embodiment as compared to a face seal embodiment. Another aspect of the present invention is ease of connector assembly and disassembly. In accordance with embodiments of the present invention, cartridges may be secured in a female connector using a gasket or an o-ring and a retainer nut or using either of the gasket or the o-ring with a retaining ring.

Figure 3:
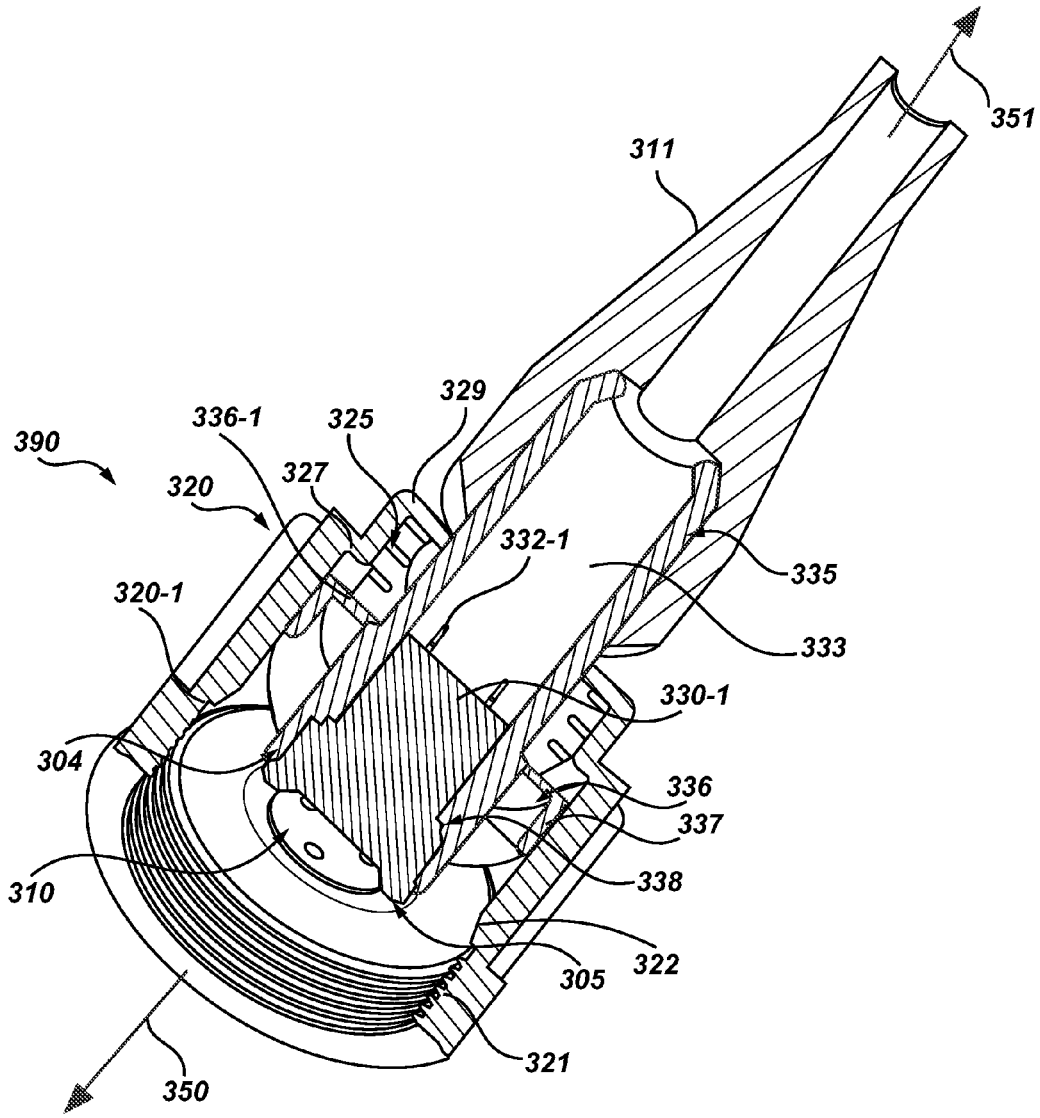
FIG. 3 shows a cross section of the exemplary female plug with a gel cartridge, taken along line XX of FIG. 1A, in accordance with an embodiment of the present invention.

FIG. 3 shows a cross section view of an exemplary female plug with gel cartridge in accordance with an exemplary embodiment of the present invention. More particularly, FIG. 3 shows a cross section view across a center axis along the length of the female plug, such as line XX in FIG. 1A. FIG. 3 shows a socket insert, gel cartridge and retainer nut as a single cross section unit 330-1, similar to FIG. 2A. In accordance with an exemplary embodiment of the present invention, when a gel cartridge is installed in a female plug connector 390, as shown in FIG. 3, the female sockets are sealed from water ingress.

At a forward coupling end 350 coupling nut 320 has a first inner diameter. From this foreground, internal threads 321 on the coupling nut 320 end moving aft 351 with a small gap 320-1. Just aft 351 of the small gap 321-1 is ramp 322 to a smaller second inner diameter of coupling nut 320. The inner diameter of the coupling nut remains at this constant second inner diameter until a step 327 down to a smaller third diameter. The third inner diameter continues until an aft end 329 of the coupling nut 320 is reached. The inner wall of the coupling nut at its third diameter aft step 327 with the back end 329 of coupling nut 320 form a cup, which houses a wave spring 325. The wave spring circumscribes female shell 335 and is lodged between the back end 329 of the coupling nut and an aft end 351 of the channel 336. Socket insert 330-1 fits into the female shell 335.

Secured in the socket insert 330-1 are female sockets 332, where the conductor attachment ends 332-1 of respective female sockets are shown. A retainer nut 305 secures the gel cartridge 310 to the female shell 335. In accordance with an exemplary embodiment, female shell 335 cavity 333 is filled with epoxy, as also described above with reference to FIGS. 2A and 2B, affixing female insert 330-1. In accordance with an exemplary embodiment, external threads on the retainer nut 305 mate with internal threads, not shown, on a forward end 304 of female shell 335. Female shell 335 comprises a small channel 336 with an external wall 337 having an external diameter the near the second inner diameter of the coupling nut 320. An aft 351 wall 336-1 of the channel 336 is used in compression of the wave spring 325, described below. In accordance with the exemplary embodiment of FIG. 3, socket insert 330-1 seats on an inner ledge 338 of female shell 335. An inner hollow of over mold 311 provides a housing for socket wires.

Figure 4:
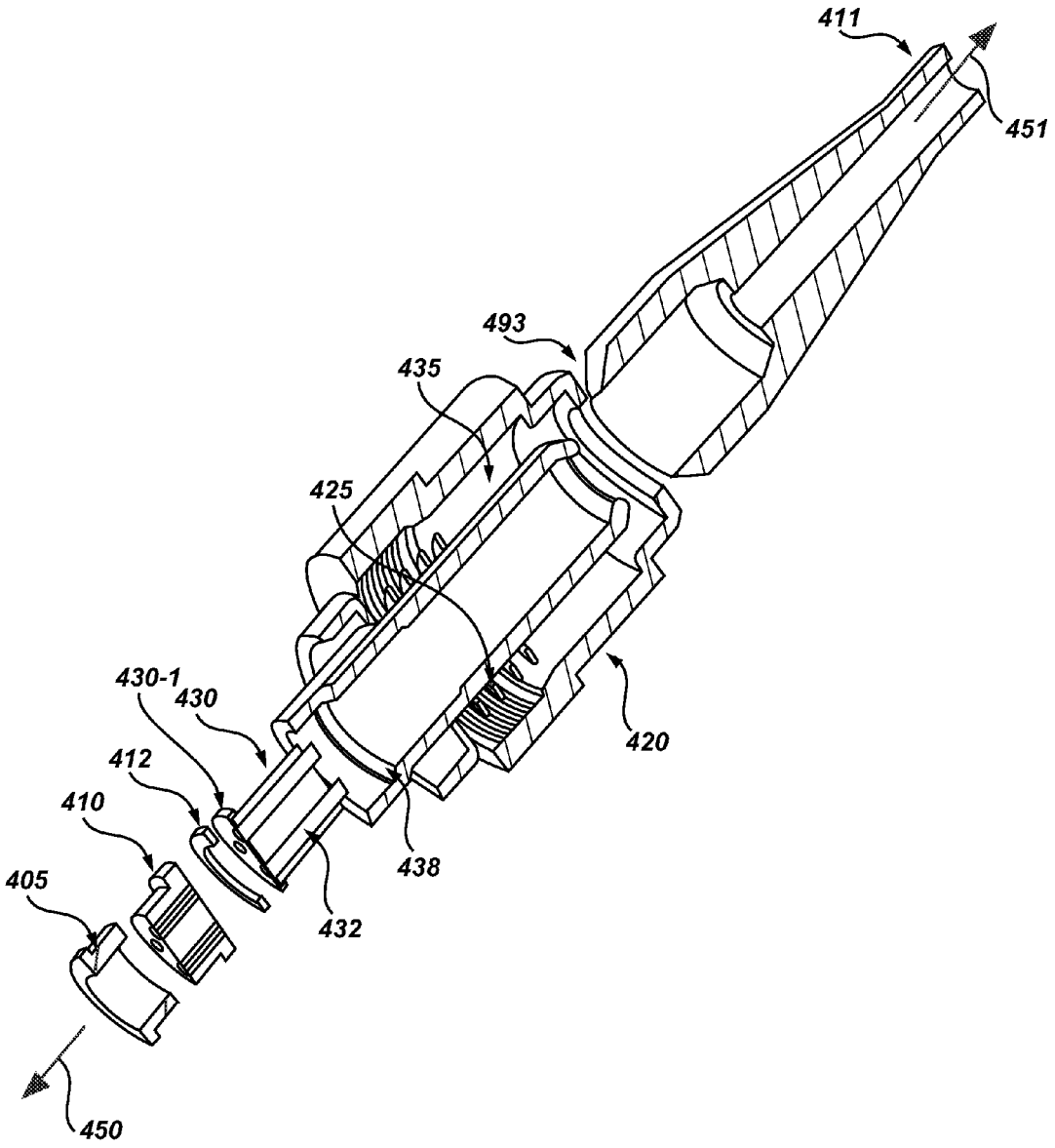
FIG. 4 shows an exploded cross section view of FIG. 3's exemplary female plug, in accordance with an embodiment of the present invention.

FIG. 4 shows an exploded cross section of FIG. 3's exemplary female plug, in accordance with an embodiment of the present invention. A flat gasket 412 may provide the seal between the rear housing of gel cartridge 410 and the front 450 face of the socket insert 430. In alternate embodiments, the flat gasket may be replaced by another suitable seal, such as a rubber washer or an o-ring. If an o-ring is used a corresponding groove in either or both of the rear housing and the socket insert may be present. A lip 430-1 on the socket insert 430 may seat on a step 438 in female shell 435 of the female plug.

The socket contacts 432 pass through the socket insert 430. Retainer nut 405 has external threads, not shown. The nut may also have flats for wrenching the gel cartridge 410 into the female shell 435. Corresponding internal threads in the female shell 435 are not shown. The nut 405 may be made of plastic. Referring to FIG. 1B, The front 140 and rear housing 170 may also be made of plastic, polymer, epoxy or equivalent material. Referring to FIG. 2B, the gasket 212 and retainer nut 205 are shown secured in place, and shown separated in FIG. 4, 412, 405, such as during assembly in FIG. 4.

Referring again to FIG. 1B, In practice, the two front and rear 140, 170 housing parts press together across respective flanged surfaces of the front housing 146 and the rear housing 176, in accordance with an exemplary embodiment.

FIG. 2B shows the female plug side of the connector comprises sockets 232 to receive the contact pins. Referring again to FIG. 4, from a forward end 450, the retainer nut 405 secures a gel cartridge 410 into the female plug connector, when assembled. Washer 412 provides a seal across the socket insert 430 and the gel cartridge 410 and keeps water from entering at this junction. Coupling nut 420 houses the wave spring 425. Coupling nut 420 may connect the female shell 435 with the over mold 411 at its rearward 451 end. In accordance with an exemplary embodiment, the retainer nut 405 has external threads for mating with internal threads of the female plug at, for example, female shell 435. Step 438 provides a seat for socket insert 430. In accordance with an alternate exemplary embodiment, the cartridge 410 may be secured to the female shell by a retaining ring.

Figure 5A:
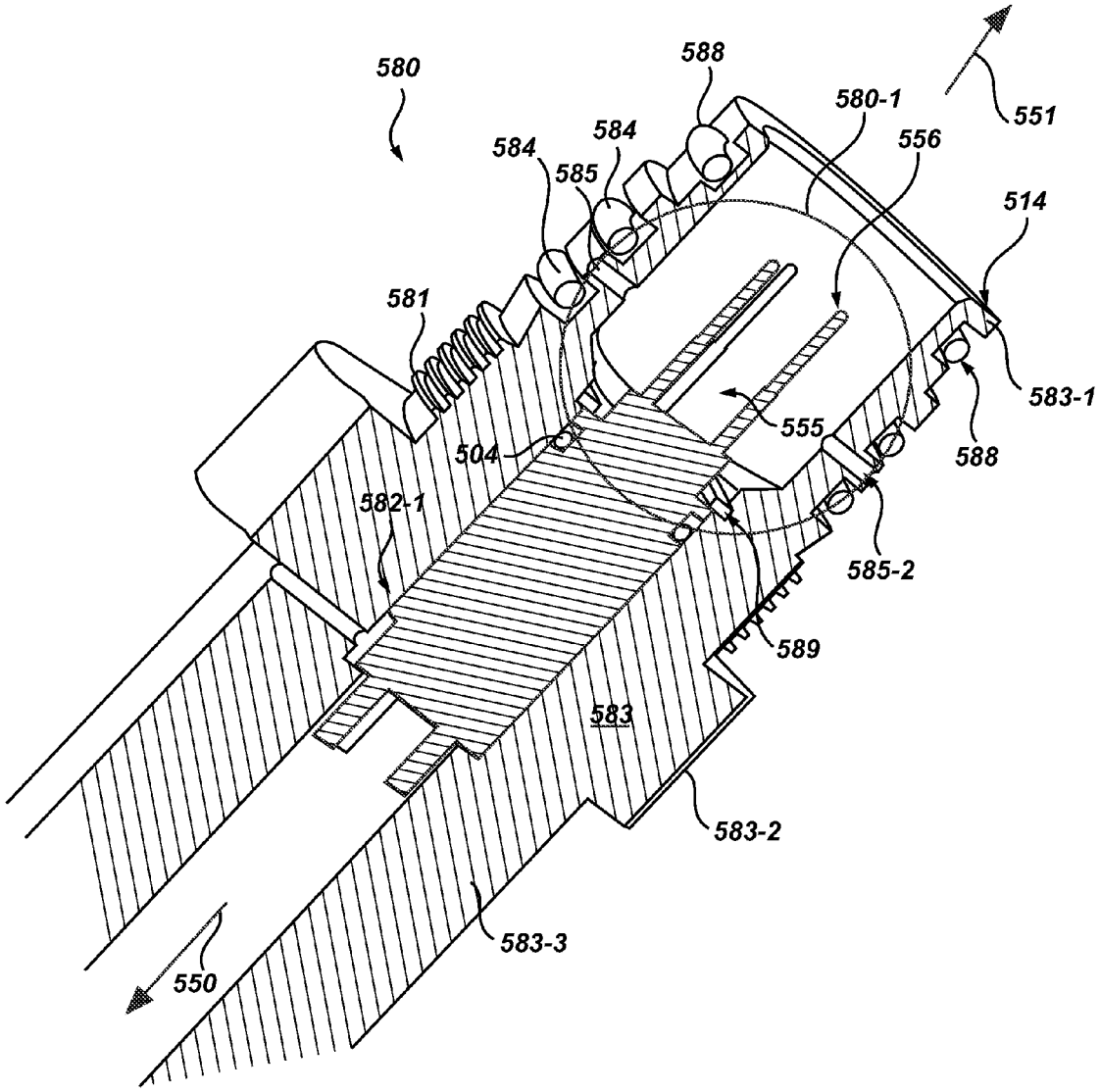
FIG. 5A shows a cross section view of an exemplary male receptacle, taken along line XX of FIG. 1A, in accordance with an embodiment of the present invention.

FIG. 5A shows a cross section view of an exemplary male receptacle, taken along line XX of FIG. 1A, in accordance with an embodiment of the present invention. Receptacle insert and contact pins are shown as single unit 582-1. Receptacle connector 580 has an outer housing 583, which may comprise a collar 583-2, external threads 581, a penetrator 583-3 and an aft 551 end 583-1. The outer housing 583 is also indicated in FIGS. 2A and 2B, 283. The meeting of the aft 251 end of the receptacle 283-1 with channel 236 is shown in FIG. 2B.

Figure 5B:
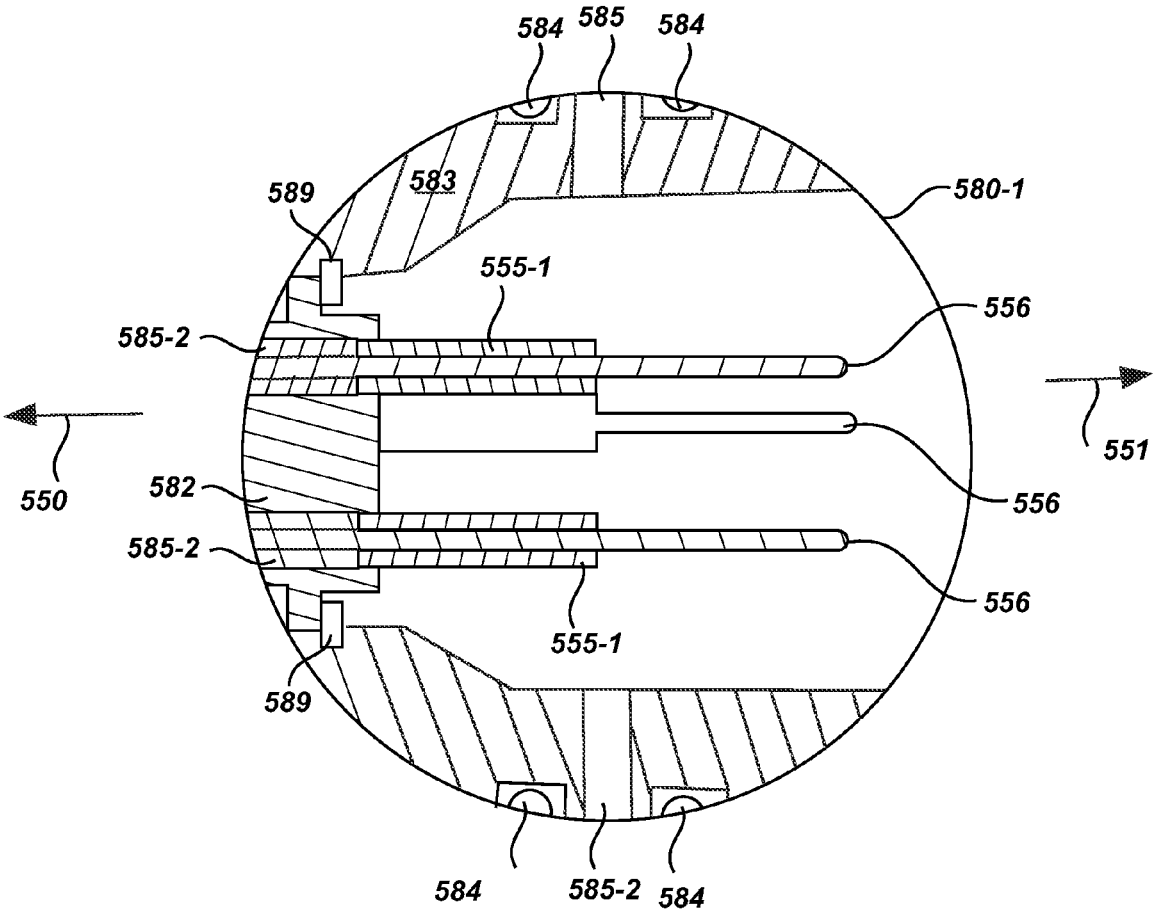
FIG. 5B shows a contact pin region of FIG. 5A in greater detail.

FIG. 5B shows a contact pin region 580-1 of FIG. 5A in greater detail. Insert 580-1 is rotated in FIG. 5B relative to FIG. 5A and resulting forward 550 and aft 551 directions are shown for ready reference. Each pin 556 installed in the pin insert 582 of the receptacle connector 580 has two insulation regions. One insulation region 555-1 is toward the by of each respective contact pin 556. This insulating region may rest in the dielectric gel contained inside the replaceable cartridge, for example resting within guide-through 173, as shown in FIG. 1B. Referring again to FIG. 5B, the other insulating region 555-2 is housed within the pin insert 582. This insulation assists in preventing any residual water from potentially forming a conductive path between pins or between a pin 556 and housing 583. The pin insert 582 is secured with retaining ring 589. Referring to FIG. 5A, the pin insert 582 is also installed with o-ring 504 to avoid ingress of water into the electric wires behind the pin insert. Water vent holes 585, 585-2 are shown in FIGS. 5A and 5B and are made through the outer housing 583 to allow water escape during a connection operation and to permit water entry during disconnect.

Referring to FIG. 5A, external threads 581 mate with internal threads of a coupling nut on a female plug connector, not shown. In accordance with an exemplary embodiment, the receptacle 580 has 2.00×12 threads 581 for connection with the coupling nut. Vent o-ring seals 584 seal with an interior face of a coupling nut securing the receptacle connector to the female plug connector and preventing ingress of water through the channels 585-2, 585 between the two o-rings 584, where coupling is shown, for example, in FIG. 2A.

When the receptacle connector 580 is connected to a female plug connector, in accordance with an exemplary embodiment of the present connector, o-ring seal 588, as shown in FIG. 5A, assists in forming a seal across the receptacle and female plug. More particularly, o-ring 588 assists in forming a circumferential seal with a channel in the female connector, where the channel 336 is shown, for example in FIG. 3. Referring to FIG. 5A, an aftward 551 face 514 of the receptacle connector 580 meets with, referring to FIG. 3, a channel end 336 of a female shell 335 when the receptacle and female plug parts mate. The mated position is shown, for example, in FIG. 2A.

Referring again to FIG. 2A, the water channel 285-1 and water vent holes 285-2, 285 combine to allow water to escape during mating of the female plug 290 and receptacle 280 underwater. In turn, trapping incompressible water may be minimized. Similarly, the water channel 285-1 and vent holes 285-2 combine to afford water reintroduction during disconnection of the two halves. The reintroduction of water can assist in breaking any vacuum between the connectors 280, 290 underwater assisting in separation of mated halves. When the connectors are completely mated, the water vent holes 285-2, 285 are closed via o-ring pair 284 and the inside wall of the coupling nut. If mating of the female plug and receptacle occurs at a first lower pressure environment and then, the mated connector moves to a higher pressure environment, the o-rings in combination with the coupling nut assist in maintaining the lower pressure within the mated connector. The seals formed across the o-rings and the inner wall of the coupling nut provide a watertight pressure seal. The seals in combination with the rigid receptacle housing, rigid female plug housing, and rigid coupling nut maintain the pressure differential across the interior of mated connector and the external environment.

Figure 6A:
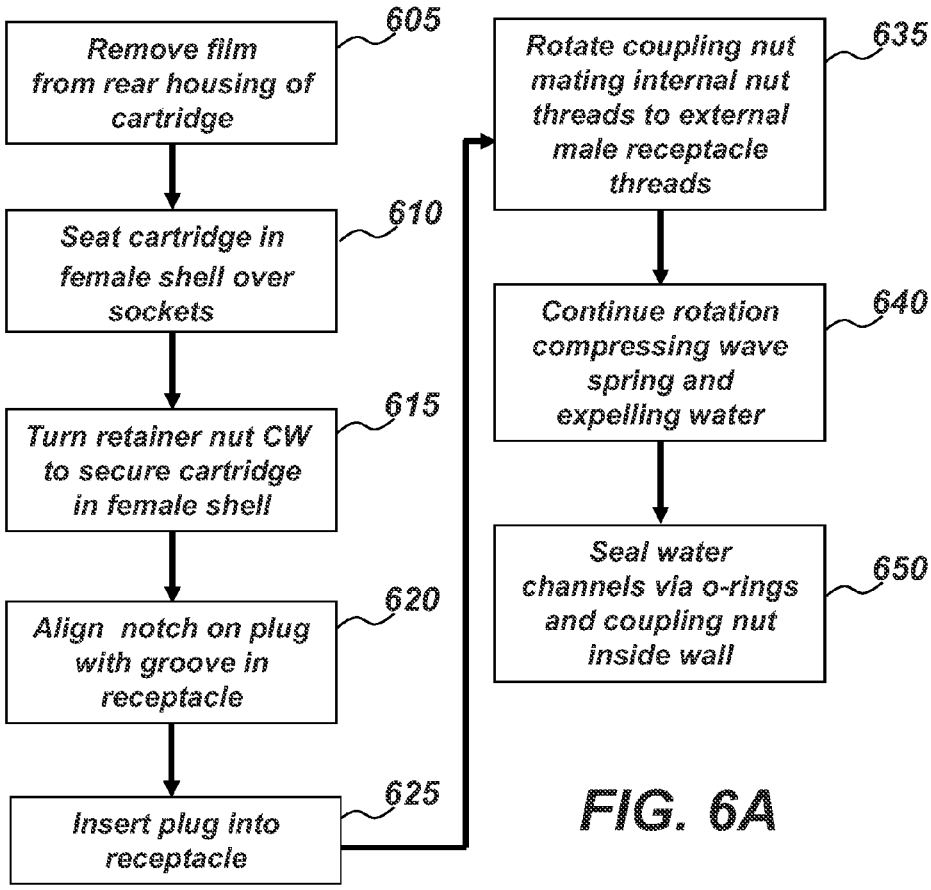
FIGS. 6A and 6C show a method of connecting and disconnecting a connector, respectively, in accordance with an exemplary embodiment of the present invention.
Figure 6B:
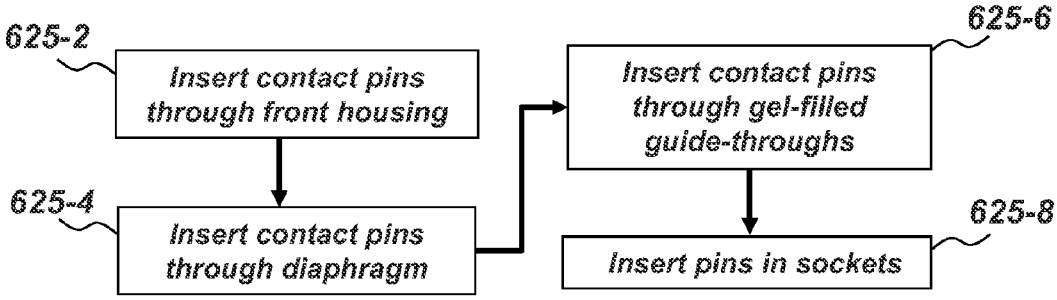
FIG. 6B shows a portion of the method of 6A in greater detail.
Figure 6C:
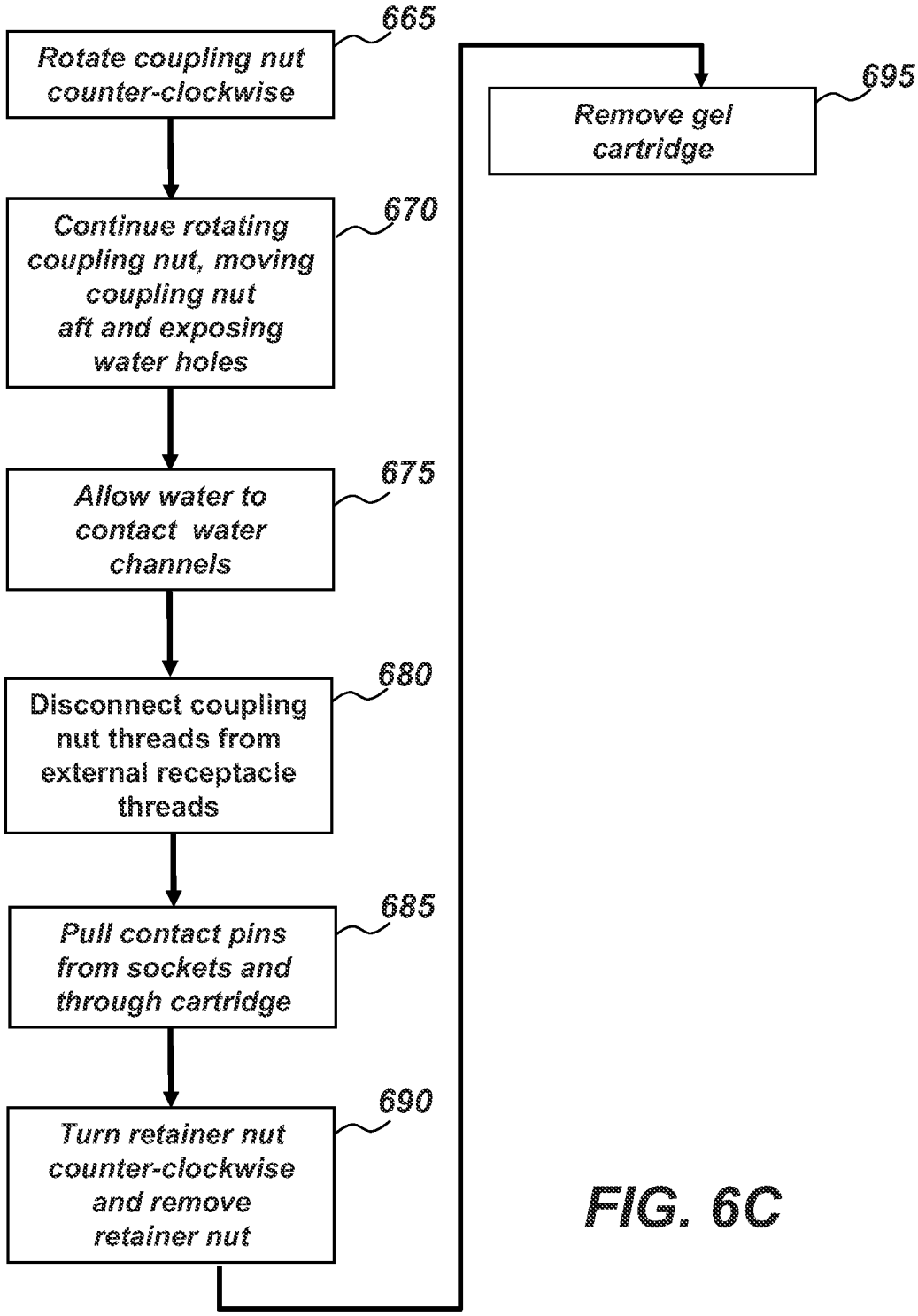

FIGS. 6A and 6C show a method of connecting and disconnecting a connector, respectively, in accordance with an exemplary embodiment of the present invention. In FIG. 6A, the connecting method includes installation of the gel cartridge into a female plug in a dry environment. In practice, the gel cartridge may be installed previously and separately from the connecting method. Turning to FIG. 6A, forming a connection begins with, removing film from the rear housing of the gel cartridge 605. The film is disposable and serves to prevent the hydrophobic gel from leaking out of the pin guide-throughs. With the film removed, the connection method continues with seating the cartridge over the sockets and into the female shell 610. Once seated, turn the retainer nut clockwise to secure the cartridge into the female plug 615. Once the cartridge is secured in the female shell, the connecting method may be performed in a wet or even an underwater environment. Align female plug and receptacle, more particularly according to an exemplary example, align notch on male receptacle with groove on female plug 620. Insert the female plug into the receptacle 625. Inserting the female plug into the receptacle 625 is described in further detail with reference to FIG. 6B.

Inserting the female plug into the receptacle 625 can be described in additional detail. The insertion path of the pins through the cartridge and into the sockets of the receptacle, or the insertion method of the pins into the sockets is further described with reference to FIG. 6B. Insert contact pins of receptacle through a front housing of the cartridge 625-2, and on through the diaphragm 625-4. The front housing has chamfered openings to assist in aligning the contact pins with the front housing. The diaphragm, is elastomeric and fits tightly around the pins on its backside, holding water on the pins back, toward the front housing. Having been wiped, the pins are further inserted through the gel-filled pin guide-throughs 625-6. Once through the gel, insert pins into the female sockets 625-8. Referring, again, to FIG. 6A, position coupling nut and rotate coupling nut clockwise, mating its internal threads to external threads on receptacle 635. In accordance with exemplary embodiments of the present invention, positioning the coupling nut and rotating the coupling nut clockwise to mate its internal threads to external threads on receptacle 635, will insert the female plug into the receptacle 625 during rotating of the coupling nut, essentially performing 625 and 635 simultaneously. Referring again to FIG. 6A, continue rotation of coupling nut, further compressing wave spring housed in coupling nut 640. Seal water path via o-rings positioned on either side of water vent hole in receptacle and coupling nut's inside wall 650.

A method of disconnecting a \vet mateable connector in accordance with an exemplary embodiment of the present invention is summarized in FIG. 6C. Holding receptacle connector stationary, rotate coupling nut counter clockwise 665. Continue rotation, moving coupling nut aft and exposing water holes on the exterior surface of the receptacle 670. Allow water to enter the water channel 675. Continue rotating coupling nut, disconnecting coupling nut threads from external receptacle threads 680. Pull contact pins from sockets and through gel cartridge 685. Turn the cartridge's retainer nut counter clockwise, freeing the cartridge threads from the female shell threads 690. Remove the gel cartridge 695. The embodiment describe with reference to FIG. 6C is exemplary. The receptacle may be anchored, perhaps penetrating a water vessel hull. Rotation of the female plug is prevented during rotation of the coupling nut by, for example, a key between the female plug and the receptacle. Removal of the gel cartridge may be postponed and need not be part of the disconnecting method. It may be desirable to perform cartridge removal in a dry environment. In accordance with exemplary embodiments, both the coupling nut and the retainer nut have flat faces to accommodate rotation via wrenches. In accordance with an alternate embodiment, the coupling nut has grooves to accommodate rotation using a spanner wrench. The gel cartridges are relatively simple, easy to install, and inexpensive. These cartridges may, in turn, be replaced with each disconnect and reconnect sequence, or if the environment permits, may be reused.

Referring to FIG. 3, the wave spring 325 is in a compressed state before mating the female plug with the male receptacle. The wave spring 325 is compressed between the aft end 329 of the coupling nut 320 and the aft 351 wall 336-1 of the channel 336 during assembly of the female female plug connector. The compression of the wave spring provides a preload to assist in overcoming the friction between o-ring 288 and wall 237, shown for example in FIG. 2B, during connector mating and to overcome the pin into socket insertion forces. In turn, the female plug fully seats into the receptacle as the coupling nut is turned to engage the coupling nut's internal threads with the external threads of the receptacle. Further rotation of the coupling nut 220 closes off the water vent holes 285, 285-2, shown for example in FIG. 2B, and further compresses the wave spring.

Embodiments of the present invention afford easy assembly and disassembly of the connector. A replaceable insert may increase the longevity and useful life of the connector. A replaceable, waterproofing, and gel cartridge, in accordance with the present invention, may be adapted for use with a variety of female connectors, wherein male pins penetrate the cartridge and make contact with female sockets. If a gel is contaminated with, for example, water, or electrically conducting impurities, the cartridge can be replaced. Loss of gel through connecting and disconnecting operations can be remedied with cartridge replacement.

The invention has been described and shown relative to a four pin and four socket diamond pattern connector. In keeping with the spirit of the invention the number and pattern of pins to be accommodated is readily modified with a corresponding change in guide-through number and pattern as well as corresponding changes in the front and rear housings and the diaphragm. Similarly, in some applications, a retaining ring may be preferred over a retaining nut to secure the gel cartridge. The bulk of a retaining nut may lead to an increase in female plug size beyond that which is desired.

Exemplary embodiments of present invention may be appropriate for submarine and wet environment applications. A receptacle, in accordance with embodiments of the present invention, is not limited to a hull penetrator. For example, the penetrator may be a bulkhead connector in which sea water and corresponding depth pressure exist on both a forward 150 and an aft 151 end, as shown in FIG. 1C, of the male receptacle.

In other embodiments, a male receptacle of the present invention may have an adapter configuration. For example, the male receptacle adapter may mate with a respective female plug on each end. In turn, each female connector would house a gel cartridge.

As is common in the electrical connector art, male receptacle 280 refers to a mechanical receptacle which includes pin electrical contacts. Similarly, female plug 290 refers to a mechanical plug configuration that includes socket electrical contacts. In alternate embodiments of a wet-mateable connector in accordance with the present invention, the sockets may be housed in a receptacle connector and in turn mate with a male plug. In such an embodiment, the gel cartridge in combination with a socket insert would seat in the receptacle. The gel cartridge would be absent from the plug connector and the plug would comprise contact pins instead of sockets.

What is claimed is:

1. A mated electrical connector comprising:
a female plug;
a male receptacle;
a replaceable cartridge seated in the female plug, the cartridge comprising:
a front housing;
a diaphragm juxtaposition a rear face of the front housing;
a rear housing juxtaposition a rear face of the diaphragm;
wherein, pin pathways align through the front housing, the diaphragm and rear housing; and
wherein, the cartridge is filled with a hydrophobic dielectric gel; and,
wherein, water is voided across a mating connection as between the male receptacle and the female plug during the mating of the female plug to the male receptacle underwater.

2. The connector of claim 1, further comprising:
perforations of conical shape disposed through the diaphragm from a front to a rear side;
wherein, a perforation diameter in the rear side is less than a pin diameter, and another perforation diameter in the front side is greater than the pin diameter; and
wherein, the diaphragm is made of an elastomeric material.

3. The connector of claim 1, further comprising:
funnel-like through-guide openings for pins disposed in the rear housing of the replaceable cartridge.

4. The connector of claim 3, further comprising:
insulation disposed on contact pins, configured to rest in the hydrophobic gel when the female plug and the male receptacle are mated.

5. The connector of claim 3, comprising:
tapered ribs disposed in the funnel-like through-guide.

6. The connector of claim 5, further comprising:
four tapered ribs placed at a separation of 90 degrees.

7. The connector of claim 1, further comprising:
a coupling nut circumscribing the female plug and having inner threads; and external threads on the receptacle which mate with the inner threads of the coupling nut.

8. The connector of claim 7, further comprising:

a wave spring housed in the coupling nut, which circumscribes a female shell.

9. The connector of claim 1, further comprising:

a gasket sandwiched between the rear housing of the gel cartridge and a socket insert, abutting against the rear housing and the socket insert and forming a seal.

10. The connector of claim 1, further comprising:

a retainer nut having external threads;

internal threads on a female shell, which mate with the external threads of the retainer nut; and wherein the retainer nut secures the gel cartridge to the female plug.

11. The connector of claim 10, further comprising:

a channel in the female shell configured to couple with a front of the male receptacle.

12. The connector of claim 1, further comprising:

water channels and vent holes configured in series to form pathways for water from an interior space of the male receptacle to an exterior surface of the male receptacle.

* * * * *